United States Patent [19]

Paul

[11] 4,130,610

[45] Dec. 19, 1978

[54] CHARGE FORMING APPARATUS WITH VANE ACTUATED FUEL AIR RATIO CONTROL

[75] Inventor: Howard C. Paul, Des Plaines, Ill.

[73] Assignee: Borg-Warner Corporation, Chicago, Ill.

[21] Appl. No.: 865,649

[22] Filed: Dec. 29, 1977

[51] Int. Cl.[2] ..... F02M 7/14

[52] U.S. Cl. ..... 261/36 A; 261/44 A; 261/44 F; 137/98

[58] Field of Search ..... 261/36 A, 44 A, 44 F, 261/50 A; 137/98

[56] References Cited

U.S. PATENT DOCUMENTS

| | | | |
|---|---|---|---|
| 1,840,727 | 1/1932 | Linkert | 261/36 A |
| 1,855,383 | 4/1932 | Capell | 261/50 A |
| 3,785,627 | 1/1974 | Tuzson et al. | 261/36 A |
| 3,953,547 | 4/1976 | Schoeman | 261/50 A |

FOREIGN PATENT DOCUMENTS

| | | | |
|---|---|---|---|
| 234308 | 5/1925 | United Kingdom | 261/44 F |

*Primary Examiner*—Tim R. Miles
*Attorney, Agent, or Firm*—Herman E. Smith

[57] ABSTRACT

Charge forming apparatus for forming a fuel air mixture of the type in which a stream of inducted air impinges upon a stream of fuel in a fuel dispersion gap, is provided with an air flow rate sensor which reduces the area of the fuel dispersion gap as the flow rate of inducted air increases for providing leaner fuel air ratios at higher air flow rates than would be available if the initial area of dispersion gap were retained, in short, the apparatus provides a flatter fuel-air ratio over a greater operating range than would be provided by a dispersion gap of fixed area.

2 Claims, 5 Drawing Figures

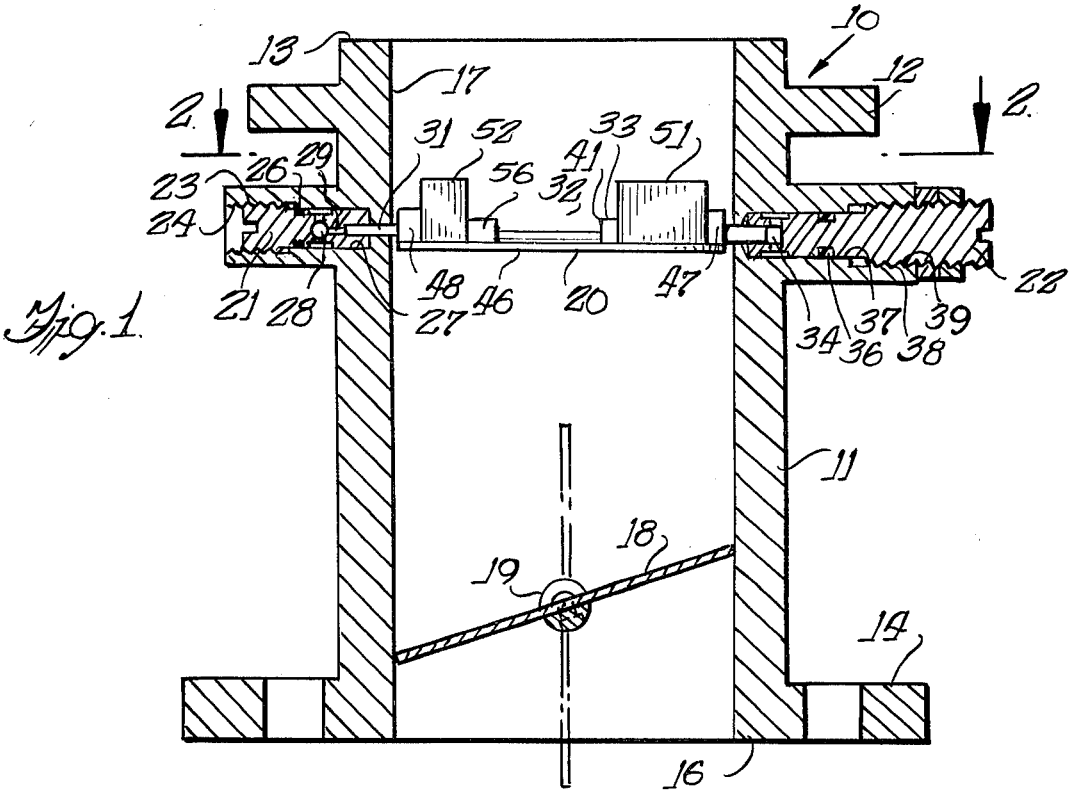
Fig. 1.
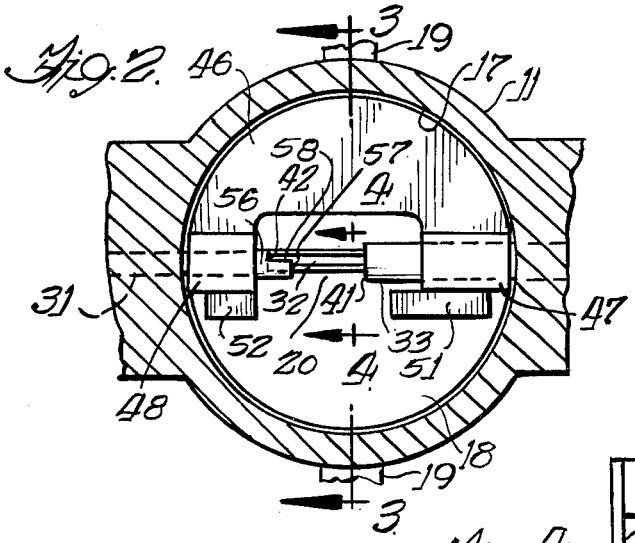
Fig. 2.
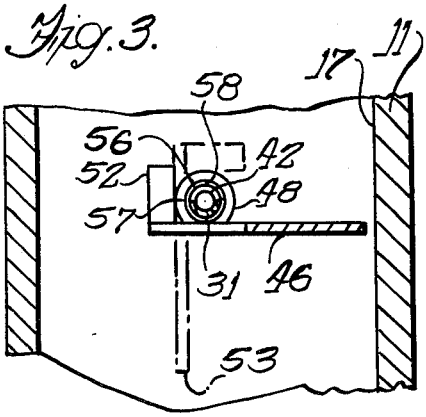
Fig. 3.
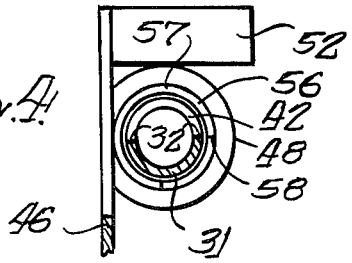
Fig. 4.
Fig. 5.
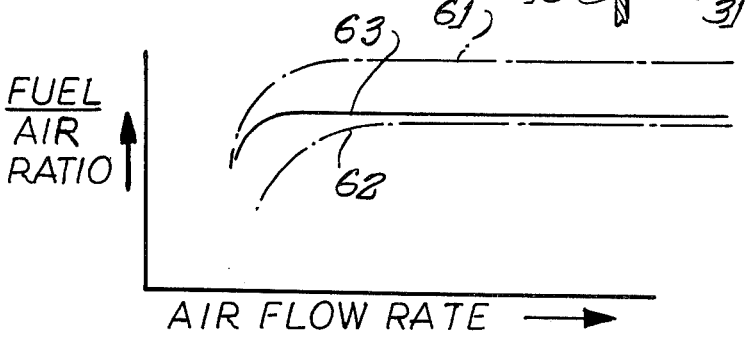

CHARGE FORMING APPARATUS WITH VANE ACTUATED FUEL AIR RATIO CONTROL

BACKGROUND OF THE INVENTION

1. Field

The present invention relates to charge forming apparatus for forming a mixture of fuel and air in which a stream of inducted air impinges upon a stream of fuel in an open portion of a fuel channel for entraining fuel into the air stream to form a fuel air mixture.

2. Prior Art

The prior art includes U.S. Pat. No. 3,785,627 which shows charge forming apparatus for an internal combustion engine in which fuel is dispersed from an opening in a fuel channel into an air stream due to impingement of the air stream upon the fuel stream, the fuel channels subject to impingement being located upstream of the throttle plate for providing a mixture during normal operating conditions. One embodiment of the apparatus shown in U.S. Pat. No. 3,785,627 shows a structure which is alternative to a conventional choke and includes a fuel channel on the downstream side of the throttle plate having a rotatable cover operable for selectively subjecting the fuel in the channel to manifold vacuum for providing a temporarily rich mixture. The prior art also includes apparatus in which the length of the fuel gap or the back pressure on the fuel stream is varied in response to a remotely sensed condition for varying the fuel air ratio during operation.

SUMMARY OF THE INVENTION

The present invention relates to charge forming apparatus for forming a fuel air mixture in which a stream of inducted air impinges upon fuel in an open portion of a fuel channel, and more particularly relates to means for reducing the area of the open portion of the channel responsive to increasing rate of air flow for maintaining desired mixture proportions over an extended range of air flow rates. The present invention contemplates a pivotal vane disposed in a stream of inducted air and arranged for moving a mask to cover portions of an opening in a fuel channel responsive to increased rates of flow of inducted air.

BRIEF DESCRIPTION OF THE DRAWING

FIG. 1 shows an elevation section view of charge forming apparatus according to the present invention;

FIG. 2 shows a section view taken along the line 2—2 of FIG. 1;

FIG. 3 is a fragmentary section view taken along the line 3—3 of FIG. 2;

FIG. 4 is an enlarged fragmentary view taken along the line 4—4 of FIG. 2; and

FIG. 5 is a graph of fuel air ratio plotted as a function of air flow rate.

DESCRIPTION OF THE PREFERRED EMBODIMENT

Referring now in more detail to the drawing charge forming apparatus 10 for forming a fuel and air mixture is shown in section in FIG. 1. A body 11 is substantially cylindrical in shape and includes an upper collar 12 for supporting an air cleaner adjacent an air inlet end 13, and a lower flange 14 adjacent mixture outlet end 16 for connection to an inlet manifold of an internal combustion engine. An air induction passage 17 is formed internally of body 11 extending from air inlet end 13 to mixture outlet end 16. A throttle member 18 is rotatably mounted in induction passage 17 by means of a shaft 19. Throttle member 18 is shown in solid line in FIG. 1 in a position obstructing induction passage 17 such as to prevent the flow of an air stream therethrough, and is movable toward a broken line position in which the blade is parallel to the induction passage presenting least restriction to a stream of inducted air. Throttle member 18 is rotatable between the solid line and broken line positions of FIG. 1 for restricting the rate of flow of air in induction passage 17.

A liquid fuel bridge 20 extends across induction passage 17 and is located between the throttle member 18 and the air inlet end 13 of the induction passage. A fuel inlet fitting 21 is located on one side of body 11 and a fuel outlet fitting 22 is located on the opposite side thereof. Fuel inlet fitting 21 includes a threaded portion 23 received in a threaded portion 25 of body 11. A seal ring 26 encircles fitting 21 forming a fluid tight seal with a bore 27 in body 11. Fitting 21 includes passages 28, 29 which communicate with a source of liquid fuel. A hollow jet tube 31 forms a portion of a fuel channel communicating with the fuel passage 29 and extending across inlet passage 17. Jet tube 31 is provided with an open fuel dispersion gap 32 which faces toward inlet end 13 of passage 17 so as to receive the impact of a stream of inducted air passing through induction passage 17. A hollow receiver tube 33 forms a portion of the fuel channel and receives one end of jet tube 31. Receiver tube 33 extends through an opening in the wall of passage 17 and is secured to outlet fuel fitting 22. Hollow receiver tube 33 is in communication with fuel outlet passage 34 in outlet fitting 22 which in turn communicates with a fuel return line. Outlet fitting 22 is provided with a seal ring 36 which provides a fluid tight seal with a bore 37 in body 11. A threaded portion 38 of outlet fitting 22 engages a threaded portion 39 of body 11. Outlet fitting 22 is threaded in or out in order to adjust the position of end 41 of receiver tube 33 and thus define one end of the despersion gap 32. As shown in FIG. 2, dispersion gap 32 is limited at one end by the end 41 of receiver tube 33 and at the other end by a notch 42 in jet tube 31.

An air flow rate sensor is mounted in induction passage 17 for sensing the flow rate of a stream of inducted air flowing in passage 17. The flow rate sensor includes a vane 46 provided with journal portions 47, 48 and counterweights 51, 52. Journal portion 48 encircles jet tube 31 while journal portion 47 encircles receiver tube 33. Counterweights 51, 52 are arranged on one side of the journals 47, 48 while vane 46 extends from the opposite side thereof. Under conditions of no air flow through passage 17, the counterweights 51, 52 bias the vane 46 to a position extending transversely with respect to passage 17. As the flow rate of the inducted air stream increases toward maximum, the vane 46 is rotated with respect to the fuel channel 31, 33 to a position in which the vane extends substantially parallel with respect to induction passage 17. The minimum flow rate position of vane 46 is shown in solid lines in FIG. 3 while the maximum flow rate position of the vane is shown in broken lines 53 in the same figure. If desired, a biasing spring may be employed instead of counterweights 51, 52 for urging vane 46 to a position extending transversely of passage 17 under conditions of no air flow.

A mash 56 is secured to vane 46 for rotation with the vane. Mask 56 includes an end edge 57 and a side edge 58 which extend over fuel dispersion gap 32 reducing the area of the gap subject to impingement by the stream of inducted air. Under minimum air flow rate conditions, the mask is maintained in a position as shown in FIGS. 2 and 3 in which the side edge 58 of the mask is located above the dispersion gap 32. In the minimum air flow rate position, the mask 56 covers a portion of the left hand end of dispersion gap 32 as viewed in FIG. 2. As the air flow rate increases, the vane 46 rotates mask 56 such that the mask covers increasing area of the left hand end of dispersion gap 32. An enlarged fragmentary section view of the mask 56 and jet tube 31 is shown in FIG. 4 wherein mask 56 is shown in the position occupied during maximum air flow rate condition.

In FIG. 5 the broken line curve 61 shows a plot of fuel air ratios versus air flow rate which would be provided by a fuel dispersion gap 32 with mask 56 locked in a minimum flow rate position, while broken line curve 62 shows a plot of fuel air ratios which would be provided by the fuel dispersion gap if mask 56 were locked in the maximum flow rate position. The solid line curve 63 of FIG. 5 represents the fuel air ratios provided by the above described structure in which an air flow rate sensor in the form of a vane is effective to move the mask 56 to reduce the area of the fuel dispersion gap subject to impingement by inducted air as the flow rate of the inducted air increases.

In operation, a stream of inducted air passing through induction passage 17 from inlet end 13 toward outlet end 16, impinges upon a stream of liquid fuel flowing through dispersion gap 32 in the fuel channel, thereby displacing some portion of the fuel from the channel for entrainment in the air stream to form a fuel and air mixture. Where a fuel dispersion gap has a fixed area, increased rate of flow of inducted air results in stripping increased amount of fuel from the channel. In the above described apparatus the area of the fuel dispersion gap is reduced responsive to increased flow rate of inducted air in order to provide a desired fuel-air mixture over a greater range of air flow rates.

What is claimed is:

1. Charge forming apparatus for forming a fuel and air mixture including a body member having an air induction passage defined therein, a fuel channel extending across said air induction passage, said fuel channel including an exposed fuel dispersion gap permitting entrainment of fuel in air for forming a fuel-air mixture in said passage, and a movable throttle member disposed downstream of said fuel channel for regulating the rate of flow of air in said induction passage, wherein the improvement comprises means for varying the proportions of fuel mixed with air in said passage in accordance with the rate of flow of air in said passage, including a rotatable mask mounted for rotation with respect to said fuel dispersion gap, and a rotatable vane mounted in said passage and connected to said mask movable responsive to rate of flow of air in said passage for rotating said mask in a direction progressively covering portions of said fuel dispersion gap responsive to increasing rate of flow of air providing desired fuel air ratios over an extended range of air flow rates.

2. Charge forming apparatus according to claim 1, said vane having a counterweight connected thereto biasing said vane and mask to a first position with respect to said fuel dispersion gap defining a first area of exposure, said vane and mask being progressively movable from said first position in a direction reducing said area of exposure responsive to increasing rate of flow of air in said induction passage.

* * * * *